United States Patent [19]

Wegener

[11] Patent Number: 4,726,759

[45] Date of Patent: Feb. 23, 1988

[54] METHOD AND APPARATUS FOR STIMULATING AN OIL BEARING RESERVOIR

[75] Inventor: Dennis C. Wegener, Bartlesville, Okla.

[73] Assignee: Phillips Petroleum Company, Bartlesville, Okla.

[21] Appl. No.: 853,796

[22] Filed: Apr. 18, 1986

[51] Int. Cl.[4] ..... F23J 7/00; F23L 17/00

[52] U.S. Cl. ..... 431/4; 431/20; 431/157; 431/190; 166/59; 166/302; 251/212

[58] Field of Search ..... 431/4, 20, 157, 163, 431/168, 173, 190, 158; 60/39.05, 39.55; 110/147; 166/59, 302, 303; 251/212

[56] References Cited

U.S. PATENT DOCUMENTS

| | | | |
|---|---|---|---|
| 1,000,304 | 8/1911 | Sliger . | |
| 2,117,944 | 5/1938 | Cochrane | 251/212 X |
| 2,934,892 | 5/1960 | Hurlbert et al. | 60/35.6 |
| 3,159,179 | 12/1964 | De Lain | 137/545 |
| 4,023,280 | 5/1977 | Schora et al. | 251/212 X |
| 4,232,595 | 11/1980 | Cox | 98/59 |
| 4,385,661 | 5/1983 | Fox | 166/59 |
| 4,475,883 | 10/1984 | Schirmer et al. | 431/158 |
| 4,515,093 | 5/1985 | Beardmore et al. | 431/163 X |

FOREIGN PATENT DOCUMENTS

| | | | |
|---|---|---|---|
| 1223981 | 9/1966 | Fed. Rep. of Germany | 251/212 |

*Primary Examiner*—Margaret A. Focarino

*Attorney, Agent, or Firm*—Williams, Phillips & Umphlett

[57] ABSTRACT

A method and apparatus for stimulating a subsurface, oil-bearing reservoir, in which a fuel is burned in the presence of a combustion-supporting gas to produce an essentially uncontaminated flue gas at a pressure significantly above the reservoir pressure, water is intimately mixed with the flue gas, the water is vaporized to produce a mixture of flue gas and steam and the operating parameters of the water vaporization and, particularly, the fuel combustion are controlled by passing the mixture of flue gas and steam through an iris-type shutter having a variable diameter opening and varying the diameter of the variable diameter opening.

19 Claims, 5 Drawing Figures

METHOD AND APPARATUS FOR STIMULATING AN OIL BEARING RESERVOIR

The present invention relates to a method and apparatus for stimulating a subsurface oil bearing reservoir. In a more specific aspect, the present invention relates to a method and apparatus for stimulating a subsurface oil bearing reservoir by the injection of a mixture of flue gas and steam. In a still more specific aspect, the present invention relates to a method and apparatus for stimulating subsurface oil bearing reservoir by the introduction of a mixture of flue gas and steam at controlled pressures.

BACKGROUND OF THE INVENTION

When a natural reservoir pressure of an oil bearing reservoir is insufficient to produce sufficient oil to make recovery economically practical or the reservoir pressure has been depleted to the uneconomic point, by previous production, it is common practice in the art to resort to techniques generically referred to as enhanced oil recovery. While such techniques have proven practical and economic in the recovery from reservoirs containing relatively light oils, the problem of oil recovery has been further complicated by the rapid decline in the availability of light oil reservoirs. As a result, operators have been forced to consider their recovery of heavier oils which, by the very nature defy, conventional methods of production and enhanced oil recovery. One technique, which has had limited success in the recovery of heavy oils, is the injection of steam into the oil bearing formation, either through a single well, in which injection of steam and production of oil are alternated (huff and puff), or injection of steam into an injection well to displace the oil from the reservoir to a production well. There are two basic methods for steam injection which are quite distinct from one another.

The most widely used steam injection technique is one in which steam is conventionally generated by a boiler located at the surface of the earth and the steam is then injected down the well to the formation to be stimulated. This technique has the obvious disadvantage that substantial losses of heat and pressure occur during transmission of the steam down the well bore. The losses are so great that at any significant reservoir depth the steam becomes hot water by the time it reaches the reservoir. In order to compensate for this loss in temperature during transmission down the well bore, insulated tubing has been proposed and, in order to compensate for loss of heat and loss of pressure, it has been suggested that the steam be generated by a miniature down hole boiler. However, this problem persists and, in addition, the steam pressure is inherently low. Thus, this technique has been denominated the "low pressure" or "low intensity" technique. Consequently, use of this technique is limited to very shallow reservoirs having very low reservoir pressures. In addition, these techniques create a more serious problem of air pollution, since flue gases from the fuels utilized to fire the boiler must be discharged to the atmosphere and such flue gases normally contain excessive amounts of nitrogen oxides and sulfur oxides. In some cases, where large concentrations of such boiler type steam generators have been utilized in a particular oil field, further use has been suspended so that air pollution standards will not be exceeded.

The second means of steam injection, referred to as the "high pressure" or "high intensity" technique, is to burn a fuel in a combustor to produce flue gas, inject water into the flue gas to produce a mixture of flue gas and steam, and inject the mixture of flue gas and steam into the reservoir. While this technique has been utilized with the generator located near the surface of the earth, thus also having the problem of heat and pressure losses due to transmission down the well, major efforts in the development of this technique has been the development of a generator which can be lowered into the well adjacent the formation of interest. In the latter instance, losses in pressure and heat during transmission down the well are eliminated. Thus, the down hole steam generator extends the depth of the reservoirs which can be treated. In addition, in order to effectively produce a mixture of flue gas and steam at a pressure sufficient for injection into a reservoir it is necessary that the combustor utilized to generate the flue gas be a "high intensity" burner, sometimes referred to as a "high velocity" or "high pressure" combustor. Accordingly, the mixture of flue gas and steam will also be at a substantially higher pressure than steam generated by a conventional boiler, thus further extending the depths and pressures at which the technique can be practiced. Therefore, this technique has been designated the "high pressure" or "high intensity" steam injection technique. In addition to the benefits gained by producing a high pressure effluent for injection, this technique has several additional distinct advantages over the low pressure technique. Most significant, it has been found that the subsurface earth formation will scrub out most of the nitrogen oxides and sulfur oxides from the flue gas and thereby essentially eliminate the problem of air pollution. Further, it has also been found that the mixture of flue gas and steam may result in increases in oil production over steam alone, apparently because of absorption of flue gases, particularly carbon dioxide, in the oil resulting in a further reduction of the oil viscosity. In a broad sense such high pressure steam generators comprise an elongated combustion chamber, means for injecting water into the flue gas and a vaporization chamber to vaporize the water and produce a mixture of flue gas and steam. Details of a highly effective high pressure steam generator of this type, which has been successfully utilized commercially, are set forth in copending U.S. application Ser. No. 354,858 filed Mar. 4, 1982 by Robert M. Schirmer. The disclosure of this application is incorporated herein by reference.

One problem in the use of high pressure steam generators is controlling the pressure within the combustion chamber and vaporization chamber so that the combustor, in particular, can be operated at its design operating conditions, since such conditions are obviously the most efficient. While the generator can be designed to operate efficiently and effectively for a particular reservoir at a particular pressure, the reservoir pressure will normally increase as effluent is injected into the reservoir and efficient use of the generator is limited to reservoir pressures which do not greatly exceed the design pressure of the generator. Such increases of reservoir pressure at which the generator can be utilized can be compensated for by increasing the duty (MM Btu/hr) of the combustor and the flow rate or velocity through the generator, primarily by increasing the air flow rate or pressure. In addition to operating less efficiently, this alternative significantly increases the fuel requirements as well as the compression requirements for compressing the air. One solution to this problem, which is set forth in the application referred to above, is to provide a fixed diameter nozzle or orifice in the downstream end of the vaporization chamber, the diameter of which has been sized for operation with choked flow (constant flow over a limited range of conditions within the generator). At a particular ratio of the pressure downstream of the nozzle throat (roughly equivalent to the reservoir pressure) to the pressure within the vaporization chamber immediately upstream of the nozzle throat, acoustic or sonic velocity of the exhaust fluids through the nozzle throat can be attained. At this critical velocity or expansion ratio, the generator, and particularly the combustor flow, will remain constant regardless of any further decreases in the back pressure (reservoir pressure). For example, in the specific generator described in the previously mentioned application, a design pressure was about 300 psi at 500° F. for the exiting effluent temperature. Acoustic velocity or sonic velocity for these conditions would be about 1,662 feet/second. The critical expansion ratio through the nozzle is 0.5431 for the generator and design operating conditions. Consequently, at exit chamber pressure of 156 psig or lower the generator will operate at design conditions if it is fitted with a simple converging nozzle having throat diameter of 0.75 inches. Thus, in a typical Kern River reservoir in California where heavy oil is produced, the formation depth is 900 feet and reservoir pressure is about 35 psig. Operation of the generator at 156 psig would thus provide a pressure differential of 121 psi for pressuring the formation which should be adequate for forcing the hot combustion products and steam into the formation. However, if the pressure becomes sufficiently large such that the critical pressure ratio no longer exists, flow through the orifice will drop and will continue to do so as the downstream pressure (reservoir pressure) increases. For example, in order to maintain constant flow through the generator, the operating pressure of the generator would have to be increased. This would result in an increase in operating costs. Operation of the generator at choked flow conditions in a deep high pressure reservoir will thus be unnecessarily expensive. For a reservoir pressure of 1200 psig the generator would have to be operated at greater than 2200 psig in order to maintain a critical pressure ratio. In addition to the increased compressor costs, there would be associated design problems, such as the pressure drop across the walls of the generator, which of course would be substantially greater at higher operating pressures and thus require generator walls with greater thickness. It would, therefore, be highly desirable if the pressure at which the generator could be operated efficiently were extended and/or pressure at which the generator could be utilized could be readily adjusted to accomodate use in higher pressure reservoirs or to accomodate changes in reservoir pressure in a single reservoir.

SUMMARY OF THE INVENTION

It is therefore an object of the present invention to provide an improved method and appartus for stimulating a subsurface oil bearing reservoir which overcome the above and other problems of the prior art. Another object of the present invention is to provide an improved method for stimulating a subsurface oil bearing reservoir by injecting a mixture of flue gas and steam into the reservoir. A further object of the present invention is to provide an improved method and apparatus for stimulating a subsurface oil bearing reservoir by injecting a mixture of flue gas and steam into the reservoir at controlled pressures. Another and further object of the present invention is to provide an improved method and apparatus for stimulating a subsurface oil bearing reservoir by injecting a mixture of flue gas and steam into the reservoir in which the pressure of operation can be extended. A still further object of the present invention is to provide an improved method and apparatus for stimulating a subsurface oil bearing reservoir by injecting a mixture of flue gas and steam into the reservoir in which the pressure at which the operation is conducted can be intervally or continuously varied. Another and further object of the present invention is to provide an improved method and apparatus for stimulating a subsurface oil bearing reservoir by injecting a mixture of flue gas and steam into the reservoir in which fuel and/or the compression costs can be reduced. Yet another object of the present invention is to provide an improved method and apparatus for stimulating a subsurface oil bearing reservoir by the injection of a mixture of flue gas and steam into the reservoir in which the apparatus can be operated at or near design conditions irrespective of variations in reservoir pressures. These and other objects of the present invention will be apparent from the following description.

The present invention relates to a method and apparatus for stimulating a subsurface oil bearing reservoir in which a fuel is burned in the presence of a combustion supporting gas to produce a flue gas, at a pressure substantially above ambient pressure and significantly above reservoir pressure, water is injected into the flue gas to produce a mixture of flue gas and water, the mixture of flue gas and water is passed through a vaporization zone to produce a mixture of flue gas and steam, having a pressure substantially above ambient pressure and significantly above the reservoir pressure. The mixture of flue gas and steam is passed through a restricted diameter opening adjacent to the down stream end of the vaporization zone whose diameter can be varied by means of an iris type shutter, the diameter of the opening is increased or decreased by means of the iris type shutter at lower or higher reservoir pressures, respectively, and the mixture of flue gas and steam is injected into the reservoir.

DESCRIPTION OF THE PREFERRED EMBODIMENTS

The present invention will be best understood by reference to the drawings.

Figure 1:
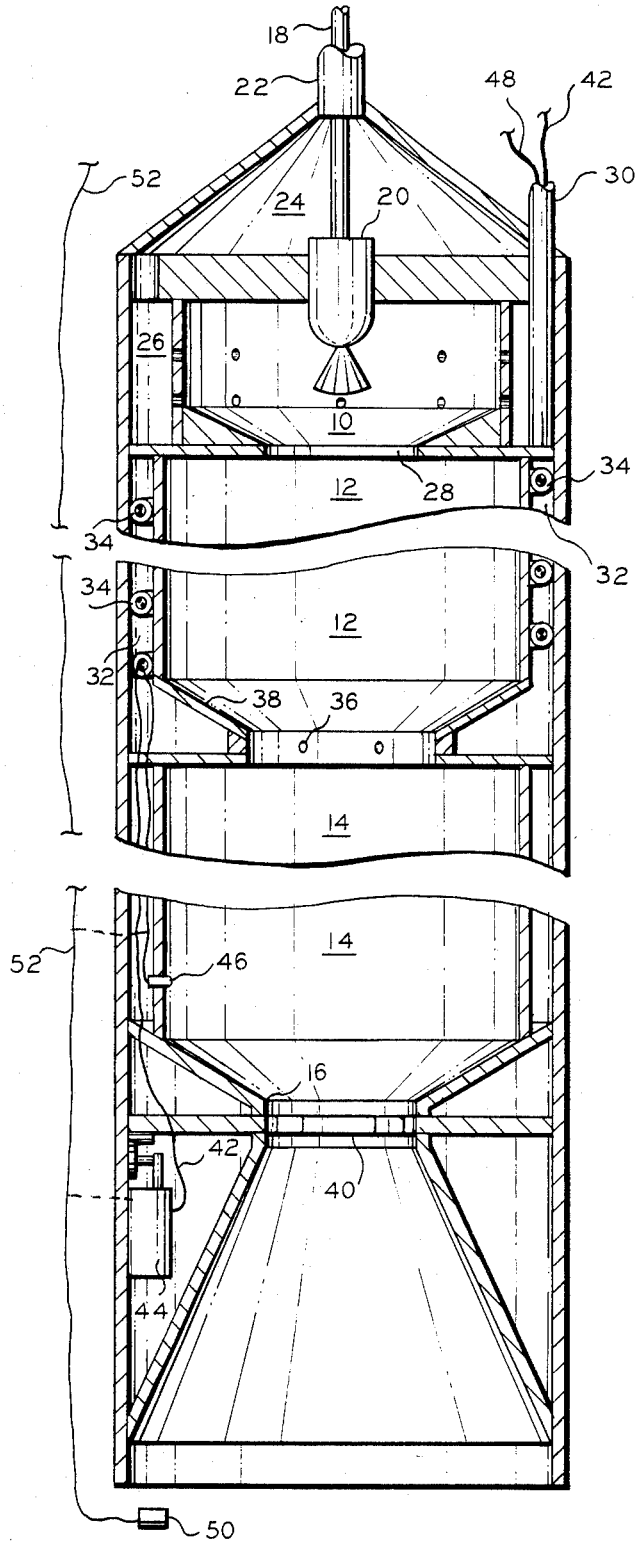
FIG. 1 of the drawings is an elevational view partially in section of a high pressure steam generator suitable for use in accordance with the present invention.

FIG. 1 of the drawings illustrates suitable apparatus for use in accordance with the present invention. As previously indicated, FIG. 1 illustrates the basic components of a combustor and vaporizer suitable for use in accordance with the present invention and the details of the construction of such a high pressure generator are set forth in the previously referred to copending application which is incorporated herein by reference.

In accordance with FIG. 1 the steam generator of the present invention comprises a fuel-air mixing zone 10 a combustion zone 12 a vaporization zone 14 and a restricted flow nozzle orifice 16. Fuel is introduced to mixing zone 10 thorugh conduit 18 and nozzle 20. The fuel from nozzle 20 is preferably introduced at a spray angle of about 90 degrees. Air is introduced into mixing zone 10 through conduit 22 through plenum chamber 24 and annular phenum chamber 26 and thence as one or more streams into mixing zone 10. The air may be introduced as a plurality of annular radially-disposed jets, tangentially as a swirling stream of air or a combination thereof. The primary requirement being that fuel and air be introduced in a manner to produce an intimate mixture of fuel and air. While mixing of the fuel and air occurs in mixing zone 10 as a result of the manner of introducing the fuel and air, such mixing is further aided by passing the mixture through restricted nozzle or orifice 28 which defines the downstream end of mixing zone 10 and the upstream end of combustion zone 12. Water is introduced to the system through conduit 30 and thence into the annular space 32 surrounding combustion zone 12. As water passes through annular zone 32 it is directed in a swirling fashion about combustion zone 12 by a spirally wound tube 34 wound about the casing of combustion chamber 12. The water is then injected into the flue gas at the downstream end of combustion zone 12 through a plurality of openings 36 in the vena contracta of a restricted diameter nozzle or orifice 38. The water may be injected into the flue gas as a plurality of radial jets which reach essentially the axis of the flue gas stream. The combination of the manner of introducing the water and the nozzle or orifice 38 are critical to the operation of the combustor and vaporizer. Specifically, the water abruptly terminates combustion and intimately mixes with the flue gas as the flue gas passes through the restricted diameter nozzle 38 and the mixture then abruptly expands into vaporization chamber 14. This technique for introducing water, terminating combustion and producing an intimate mixture of the flue gas and water substantially reduces backflow from vaporization zone 14 into combustion zone 12 which backflow would result in dilution of the flame front, incomplete combustion of the fuel, destabilization of the combustion and, in more extreme cases, extinguishing the flame. The intimate mixture of flue gas and water passes through the elongated vaporization zone 14 for a time sufficient to vaporize the water and produce a mixture of flue gas and steam. As previously indicated, it is highly desirable, in a high pressure steam generator, to be able to adjust or vary the discharge pressure or velocity of the flue gas-steam effluent in order to utilize the high pressure steam generator for the injection of steam in reservoirs having different reservoir pressures or a reservoir in which the reservoir pressure changes, so that the generator, particularly the combustor, can be operated at or near design conditions. This is accomplished in accordance with the present invention by passing the flue gas-steam mixture through a restricted opening in the downstream end of vaporization chamber 14 which, in the present case, is provided by restricted diameter nozzle or orifice 16. The size of the opening through nozzle 16 is increased or decreased by means of an iris-type shutter means 40 mounted in the vena contracta of nozzle 16. Shutter means 40 can be intervally adjusted, electrically or electronically or by fluid pressure schematically illustrated as passing from the surface of the earth through line 42. Conveniently if tubing 34 is an open tube electrical or fluid line 42 can be passed through tube 34 to an appropriate motive means 44 which in turn drives, by gear means or otherwise, the iris-type shutter 40. Accordingly, if the generator is to be operated in a reservoir having a higher pressure than that in which it has been previously been used or for which the iris type shutter 40 was set, the device can be adjusted by sending an appropriate electrically or fluid signal through line 42 to motive means 44 to thereby adjust the opening in iris type shutter 40 to open the same further. On the other hand, if a lower pressure reservoir were to be treated an appropriate signal would adjust the iris type shutter to make the opening smaller. To the extent that it is desired to adjust the opening in iris type shutter 40 in response to increases or decreases in the reservoir pressure this would be accomplished by measuring the pressure within the vaporization chamber 14 immediately upstream of iris type shutter 40 by means of a pressure detector 46 operated through line 48. Likewise, a suitable pressure detector 50 exposed in the well or in the generator downstream of iris type shutter 40 which would be operative through line 52 from the surface. Obviously line 52 can also be passed through the generator in the same manner as line 42. Accordingly, as the pressure within the reservoir, i.e., immediately downstream of iris type shutter 40 increases an appropriate signal would be delivered to motive of means 44 to increase the opening of iris type shutter 40 and to the extent the pressure in the reservoir decreases an appropriate signal would be transmitted to motive means 44 to decrease the size of the opening in iris type shutter 40.

Figure 2:
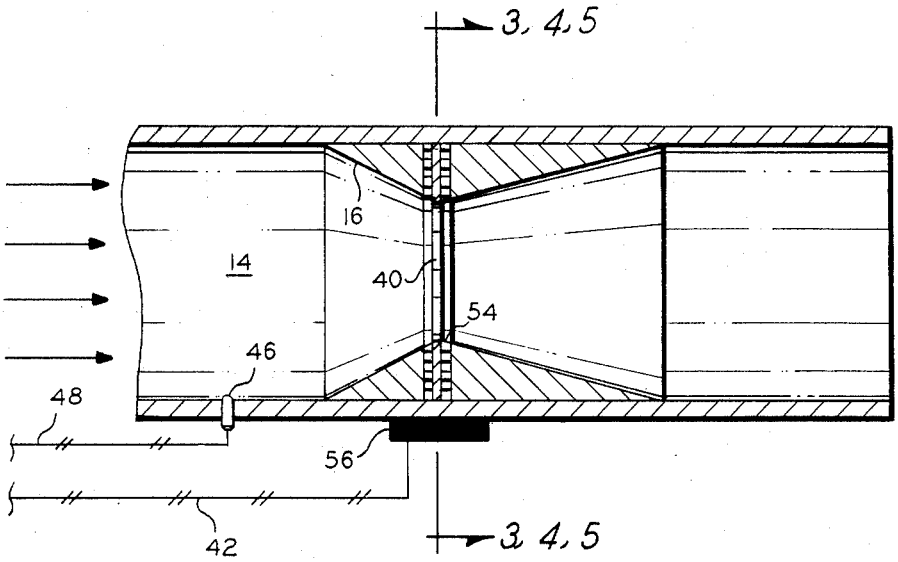
FIG. 2 is a side view partially in section of a pressure control for use in accordance with the present invention.

FIG. 2 shows a cross-sectional view of the downstream end of vaporization chamber 14 including iris type shutter 40 which, as previously indicated is an iris type variable shutter made up of a plurality of interleaved elements. The leaves of shutter 40 are mounted in appropriate mounting means 54 which in turn are is mounted in nozzle orifice 16. An electrical signal is transmitted from the surface of the earth through line 42 to an electronic orifice positioner, shown schematically as element 56.

Figure 3:
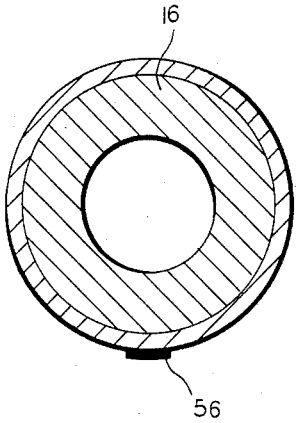
FIGS. 3, 4 and 5 are cross-sectional views taken along the line 3, 4, 5-3, 4, 5 of FIG. 2 showing relative positions of the pressure control of FIG. 2.
Figure 4:
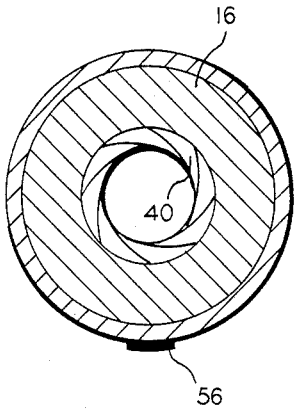
Figure 5:
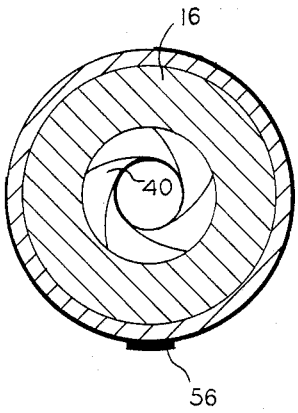

FIGS. 3, 4 and 5 are cross-sectional views taken along the lines 3, 4, 5-3, 4, 5 of FIG. 2 showing shutter 40 in a fully open position in FIG. 3, in a partially closed position in FIG. 4 and in a still further closed position in FIG. 5.

Suitable fuels use in the present invention include any normally gaseous fuel, such as natural gas, propane, etc., any normally liquid fuels such as a number 2 fuel oil, a number 6 fuel oil, diesel fuels, crude oil and other hydrocarbon fractions, shale oils etc., or normally solid, essentially ashless fuels, such as solvent refined coal oil, asphaltene bottoms, etc. Copending application Ser. No. 354,858 shows and describes suitable apparatus for burning such fuels. The fuel may also be a normally solid ash producing fuel such as coal, lignite, etc., in which case apparatus such as that shown and described in U.S. Pat. No. 4,515,093 would be utilized. In this case, the restricted diameter nozzle orifice 16 and iris-type shutter 40 would be mounted in the discharge conduit of the apparatus of the patent. Suitable combustion supporting gases can include air, oxygen enriched air or oxygen, etc. In order to produce a flue gas substantially free of unburned fuel an excess of air is utilized, preferably about three percent oxygen, on a dry basis, above the stoichiometric amount necessary for complete combustion of all of the fuel. Where a fuel is normally liquid the fuel is preferably introduced by means of a spray nozzle adapted to produce droplet sizes below about 70 microns and the fuel should have a viscosity below about 40 cSt, preferably about 20 cSt.

Either the air or fuel or both may be preheated, preferably to a temperature between about ambient temperature and 800° F. and still more preferably between about 200° F. and 500° F. The flow velocity in the combustion zone 12 is maintained above laminer flow flame speed. Generally, laminer flow flame speed for liquid hydrocarbon fuels is between about 1.2 and 1.3 feet/second and for natural gas is about 1.2 feet/second. The power output of the combustor should be at least about 7 MM Btu/hr for effective and economical stimulation of the well in most heavy oil fields. Consequently, the heat release rate of the combustion process should be at least about 50 MM Btu/hr. ft.$^3$. Such a heat release rate is about three orders of magnitude greater than the heat release of a typical oil fire boiler such as that currently used in heavy oil recovery to produce steam for injection or in a low pressure technique. The pressure of the mixture of flue gas and steam should be above about 300 psi in order for the fluids to penetrate the formation in most heavy oils fields. The steam generated may be between wet and superheat, preferably a vaporization of about fifty percent and superheat and still more preferably between about eighty percent vaporization and superheat.

While specific materials, conditions of operation, modes of operation and equipment have been referred to herein, it is to be recognized that these and other specific recitals are for illustrative purposes and to set forth the best mode only and not to be considered limiting.

That which is claimed is:

1. A method for stimulating a subsurface, oil-bearing reservoir, comprising:

(a) burning a fuel in the presence of a combustion-supporting gas, in a combustion zone, in a manner and under conditions sufficient to burn essentially all of said fuel and produce a flue gas, essentially free of unburned and partially burned fuel and having a pressure significantly above the reservoir pressure, at the downstream end of said combustion zone;

(b) introducing water into said flue gas, adjacent the downstream end of said combustion zone, in a manner and under conditions sufficient to produce an intimate mixture of said flue gas and said water;

(c) passing said flue gas and water through a vaporization zone, in open communication with and downstream of said combustion zone, in a manner and under conditions sufficient to vaporize a substantial portion of said water and produce a mixture of said flue gas and steam, having a pressure significantly above said reservoir pressure, at the downstream end of said vaporization zone.

(d) passing said mixture of flue gas and steam through an iris-type shutter, having a variable diameter opening adjacent the downstream end of said vaporization zone;

(e) at least intervally increasing or decreasing the diameter of said variable diameter opening of said iris-type shutter to decrease or increase, respectively, the discharge pressure of said mixture of flue gas and steam through said varible diameter opening of said iris type shutter; and (f) injecting said mixture of flue gas and steam into said reservoir.

2. A method in accordance with claim 1 wherein the diameter of the variable diameter opening of the iris type shutter is increased or decreased by an amount sufficient to maintain a predetermined pressure within the combustion zone.

3. A method in accordance with claim 2 wherein the predetermined pressure within the combustion zone is near the design point pressure of said combustion zone.

4. A method in accordance with claim 1 wherein the diameter of the variable diameter of the iris type shutter is increased or decreased by an amount sufficient to maintain a predetermined pressure within the vaporization zone.

5. A method in accordance with claim 4 wherein the predetermined pressures within the vaporization zone is near the design point pressure of said vaporization zone.

6. A method in accordance with claim 1 wherein the diameter of the variable diameter of the iris-type shutter is increased or decreased by an amount sufficient to maintain the ratio of the discharge pressure through said variable-diameter opening of said iris-type shutter to the pressure within the vaporization zone at least equal to about the critical pressure ratio at which choked flow through said variable diameter opening occurs.

7. A method in accordance with claim 6 wherein the ratio of the discharge pressure through the variable diameter opening of the iris-type shutter to the pressure within the vaporization zone is maintained near the critical pressure ratio at which choked flow through said variable diameter opening occurs.

8. A method in accordance with claim 1 wherein the diameter of the variable diameter opening of the iris-type shutter is increased or decreased by an amount sufficient to maintain a predetermined residence time within the combustion zone.

9. A method in accordance with claim 8 wherein the predetermined residence time within the combustion zone is near the design point residence time for the combustion zone.

10. A method in accordance with claim 1 wherein the pressure within the vaporization zone is measured and the diameter of the variable diameter opening of the iris-type shutter is increased or decreased, in response to changes in the thus measured pressure within said vaporization zone, to maintain an essentially constant pressure within said vaporization zone.

11. A method in accordance with claim 1 wherein the reservoir pressure is measured and the diameter of the variable diameter opening of the iris-type shutter is increased or decreased in proportion to increases or decreases, respectively, in the thus measured reservoir pressure.

12. A method in accordance with claim 1 wherein the pressure within the vaporization zone and the reservoir pressure are measured and the diameter of the variable diameter opening of the iris-type shutter is increased or decreased by an amount sufficient to maintain an essentially constant pressure within said vaporization zone.

13. A method in accordance with claim 1, wherein the pressure within the vaporization zone and the reservoir pressure are measured and the diameter of the variable diameter opening of the iris type shutter is increased or decreased by an amount sufficient to maintain a predetermined ratio of the thus measured reservoir pressure to the thus measured pressure within said vaporization zone.

14. A method in accordance with claim 13 wherein the predetermined ratio is at least equal to about the critical pressure ratio at which choked flow through the variable diameter opening occurs.

15. A method in accordance with claim 13 wherein the predetermined ratio is maintained near the critical pressure ratio at which choked flow through the variable diameter opening occurs.

16. Apparatus for stimulating a subsurface, oil-bearing reservoir, comprising:

(a) an elongated combustion chamber;

(b) fuel and combustion-supporting gas introduction means adapted to introduce said fuel and said combustion-supporting gas into the upstream end of said combustion chamber;

(c) said combustion chamber having a volume sufficient to burn substantially all of said fuel to produce a flue gas substantially free of unburned and partially burned fuel;

(d) said fuel and combustion-supporting gas introduction means and said combustion chamber being adapted to maintain said flue gas at a pressure significantly above the pressure of said reservoir;

(e) water introduction means adjacent the downstream end of said combustion chamber, adapted to introduce water into said flue gas and intimately mix said water with said flue gas;

(f) an elongated vaporization chamber, having its upstream end in open communication with said combustion chamber and adapted to receive said mixture of flue gas and water and a discharge opening in its downstream end;

(g) said vaporization chamber having a volume sufficient to vaporize a substantial portion of said water to produce a mixture of said flue gas and steam;

(h) said water introduction means and said vaporization chamber being adapted to maintain said mixture of flue gas and steam at a pressure significantly above said reservoir pressure;

(i) an iris type shutter means having a variable diameter opening, mounted in said discharge opening of said vaporization chamber and adapted to vary the diameter of said discharge opening of said vaporization chamber through which said mixture of flue gas and steam is discharged; and (j) motive means, operatively connected to said iris type shutter and adapted to vary the diameter of said variable diameter opening of said iris type shutter.

17. Apparatus in accordance with claim 16 which additionally includes pressure transducer means operatively connected to the motive means and adapted to measure the pressure within the vaporization chamber and move said motive means in proportion to variations in the thus measured pressure.

18. Apparatus in accordance with claim 16 which additionally includes pressure transducer means operatively connected to the motive means and adapted to measure the pressure of the reservoir and move said motive means in proportion to variations in the thus measured pressure.

19. Apparatus in accordance with claim 16 which additionally includes pressure transducer means operatively connected to the motive means and adapted to measure the pressure within the vaporization chamber and the pressure in the reservoir and move said motive means in proportion to variations in the ratio of the thus measured reservoir pressure to the thus measured pressure within said vaporization chamber.

* * * * *